US009977377B1

(12) United States Patent
Takahashi

(10) Patent No.: US 9,977,377 B1
(45) Date of Patent: May 22, 2018

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Koji Takahashi, Sumida Tokyo (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/466,038

(22) Filed: Mar. 22, 2017

(30) Foreign Application Priority Data

Mar. 13, 2017 (JP) ..... 2017-047836

(51) Int. Cl.

| | |
|---|---|
| ***G03G 15/16*** | (2006.01) |
| ***G03G 21/00*** | (2006.01) |
| ***B41M 7/00*** | (2006.01) |
| *G03G 15/00* | (2006.01) |

(52) U.S. Cl.
CPC ..... *G03G 15/1675* (2013.01); *B41M 7/0009* (2013.01); *G03G 15/1645* (2013.01); *G03G 15/6508* (2013.01); *G03G 21/0047* (2013.01); *G03G 15/5004* (2013.01); *G03G 2215/00126* (2013.01)

(58) Field of Classification Search
None
See application file for complete search history.

(56) References Cited

U.S. PATENT DOCUMENTS

| | | | | |
|---|---|---|---|---|
| 9,188,911 | B1 | 11/2015 | Takenaka | |
| 2014/0193167 | A1* | 7/2014 | Shinohara | G03G 21/0094 399/66 |

* cited by examiner

*Primary Examiner* — Thomas Giampaolo, II
(74) *Attorney, Agent, or Firm* — Amin, Turocy & Watson LLP; Gregory Turocy

(57) ABSTRACT

An embodiment provides an image forming apparatus that has a first operation mode and a second operation mode. The first operation mode forms an image on a sheet with toner. The second operation mode decolorizes the toner on the sheet on which the image is formed with a decolorable toner having a decoloring function. In the first operation mode, when the sheet passes through a transfer unit, a transfer bias having the same polarity as that of a charge of the toner is applied to the transfer member and a toner image formed on a surface of the transfer member is transferred to the sheet. In the second operation mode, when the sheet passes through the transfer unit, a cleaning bias having a reverse polarity to that of the transfer bias is applied to the transfer member.

4 Claims, 6 Drawing Sheets

DECOLORING OPERATION
ON
OFF
t11
t12
TRANSFER UNIT SHEET
PRESENT
ABSENT
t21
t22
t23
t24
CLEANING BIAS
E1
0
t31
t32
CLEANING BIAS
E1
E2
0
t41
t42
CLEANING BIAS
E1
0
E3
t51
t52 t53 t54 t55

IMAGE FORMING APPARATUS

CROSS-REFERENCE TO RELATED APPLICATIONS

This application is based upon and claims the benefit of priority from Japanese Patent Application No. 2017-047836, filed Mar. 13, 2017, the entire contents of which are incorporated herein by reference.

FIELD

Embodiments described herein relate generally to an image forming apparatus.

BACKGROUND

There is an image forming apparatus that forms an image on a sheet while transporting a sheet-like recording medium (hereinafter, collectively referred to as "sheet") such as a sheet. The image forming apparatus includes an apparatus having an image forming unit that performs a transfer step in one step and an apparatus having an image forming unit that performs a transfer step in two steps of primary transfer and secondary transfer. In the image forming unit that performs the transfer step in two steps, a visible image (toner image) which is developed by a developing device on a photosensitive member is primarily transferred on a surface of an intermediate transfer belt which is in contact with the photosensitive member. The toner image that is primarily transferred on the surface of the intermediate transfer belt is transferred to the sheet by applying a transfer bias having the same polarity as toner to the intermediate transfer belt. The toner image that is secondarily transferred to the sheet is heated and pressed by a predetermined fixing temperature, and is fixed on the sheet in a fixing unit.

There is also toner (decolorable toner) having a decoloring function capable of eliminating a color of toner by applying a predetermined temperature (decoloring temperature). The toner is decolorized by applying the decoloring temperature to a sheet on which an image is formed with the decolorable toner and the sheet can be reused. For decoloring of the toner on the sheet, it is possible to use a device dedicated to decoloring or it is possible to use an image forming apparatus. In order to decolorize the decolorable toner in the image forming apparatus, a temperature of the fixing device is set to the decoloring temperature higher than a temperature used for an ordinary image forming operation and decoloring of the sheet passing through the fixing unit is performed. In the image forming apparatus, since a transport route of the sheet to a fixing device is the same as that of the ordinary image forming operation, the sheet passes through the transfer unit even in a decoloring operation. That is, the image forming apparatus causes an intermediate belt to be rotated to transport the sheet even in the decoloring operation.

However, when the intermediate belt is rotated, the photosensitive member, which is in contact with the intermediate belt, and an auger for agitating a developer or the like in a developing unit, or the like are also rotated. In the developing unit, when the augur or the like is rotated without supplying the toner to the photosensitive member, agitation proceeds in a state where the toner is not used for development. Therefore, during the decoloring operation, the toner of the developing unit is deteriorated due to separation of a toner surface or the like due to agitation and a charge amount of the toner is lowered. When the charge amount of the toner decreases, the toner adheres to the intermediate transfer belt and the toner deposits on the secondary transfer roller or the like. Therefore, a so-called "fogging" is likely to occur on a sheet, particularly, on a back surface of the sheet. In Particular, if both the decolorable toner and a non-decolorable toner are contained in the image forming apparatus, if fogging occurs with the non-decolorable toner other than the decolorable toner in the decoloring operation, whenever the sheet passes through the transfer unit, dirt of the non-decolorable toner adheres to the sheet and the number of times of reusing of the sheet may decrease.

DESCRIPTION OF THE DRAWINGS

FIGS. 4C1, 4C2 and 4C3 are timing chart illustrating an example of cleaning bias.

DETAILED DESCRIPTION

Figure 1:
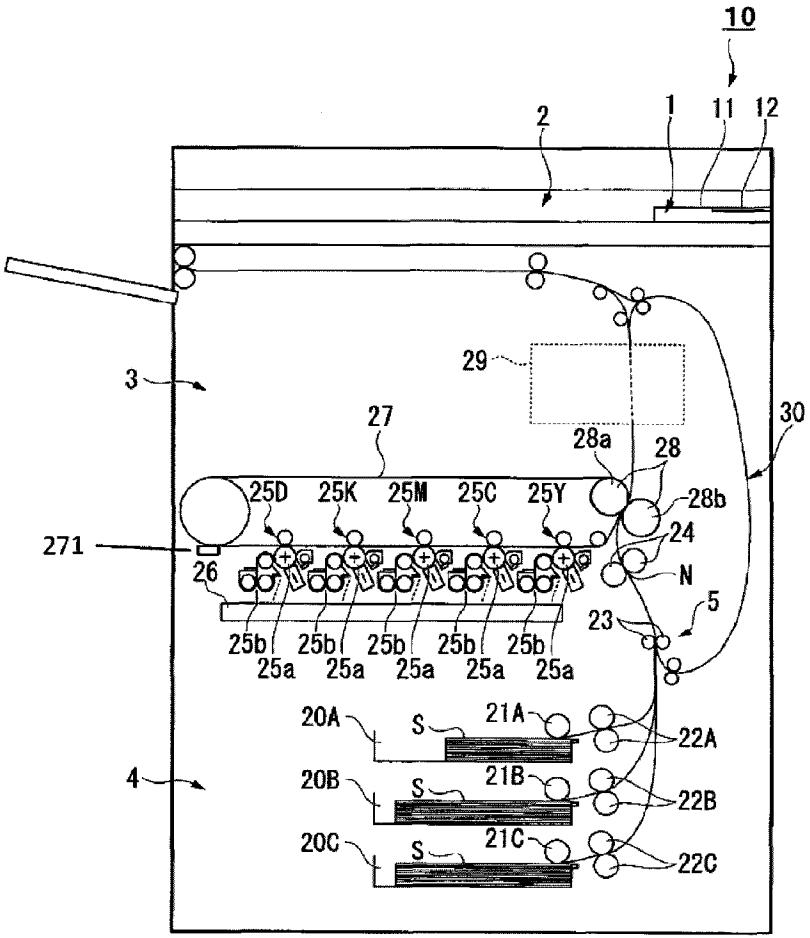
FIG. 1 is a view schematically illustrating an example of an internal configuration of an image forming apparatus of an embodiment.

An object to be solved is to provide an image forming apparatus which prevents dirt of a sheet by a non-decolorable toner during a decoloring operation of a decolorable toner and does not reduce the number of times of reuse.

An image forming apparatus of an embodiment has a first operation mode and a second operation mode. The first operation mode forms an image on a sheet with toner. The second operation mode decolorizes the decolorable toner on the sheet on which an image is formed with the toner having a decoloring function. That is, in the second operation mode, an image forming operation is not performed. In the first operation mode, when the sheet passes through a transfer unit, a toner image formed on a front surface of an intermediate transfer belt or the like is transferred to the sheet by applying a transfer bias having the same polarity as that of the charge of the toner to a transfer member. In the second operation mode, when the sheet passes through the transfer unit, a cleaning bias having a reverse polarity to that of the transfer bias is applied to the transfer member.

Hereinafter, an image forming apparatus of an embodiment will be described with reference to the drawings. In each drawing illustrated below, the same reference numerals are given to the same configurations.

An internal configuration of the image forming apparatus of the embodiment will be described with reference to FIG. 1. FIG. 1 is a view schematically illustrating the internal configuration of an image forming apparatus 10.

In FIG. 1, the image forming apparatus 10 has an operation display unit 1, a scan unit 2, a print unit 3, a sheet storage unit 4, and a transport unit 5. The image forming apparatus 10 forms an image on a surface of a sheet (S) using toner. The sheet is, for example, paper or film. The sheet may be any material as long as the image forming apparatus 10 can form an image on a surface of the sheet.

The operation display unit 1 includes a display unit 11 and an operation unit 12. The display unit 11 is a display device such as a liquid crystal display, or an organic electro luminescence (EL) display. The display unit 11 displays various types of information related to the image forming apparatus 10. The operation unit 12 includes a plurality of buttons and the like. The operation unit 12 accepts an operation of a user to the plurality of buttons. The display unit 11 and the operation unit 12 may be an integrally formed touch panel.

The operation display unit 1 selectably displays operation modes of the image forming apparatus 10. The operation modes include a normal operation mode in which a normal image forming operation is performed and a decoloring mode in which a decoloring operation for decoloring a decolorable toner on a sheet is performed. The normal operation mode is, for example, a mode in which a normal operation is executed in an image forming apparatus such as copy, FAX, scan, or the like. The normal operation mode may include an operation mode in which an image is formed by a non-decolorable toner and an operation mode in which an image is formed by the decolorable toner. In the decoloring mode, the image forming apparatus 10 functions as a decoloring apparatus that executes the decoloring operation of the sheet. The operation display unit 1 displays the operation modes and is capable of selecting an operation mode for the user with respect to the image forming apparatus by pressing buttons or the like. The scan unit 2 reads image information of an object to be read in a scan mode.

The print unit 3 forms an image on the surface of the sheet based on image data generated by the scan unit 2 in a copy mode. The print unit 3 forms an image of the surface of the sheet based on the image data received from another information processing device via a network.

The sheet storage unit 4 supplies the sheets to the print unit 3 one by one in accordance with timing at which the print unit 3 forms a toner image. The sheet storage unit 4 includes a plurality of sheet feeding cassettes 20A, 20B, and 20C. Each of the sheet feeding cassettes 20A, 20B, and 20C stores each of sheets of preset size and type. Each of the sheet feeding cassettes 20A, 20B, and 20C includes each of pickup rollers 21A, 21B, and 21C. Each of the pickup rollers 21A, 21B, and 21C takes up the sheets one by one from each of the sheet feeding cassettes 20A, 20B, and 20C. The pickup rollers 21A, 21B, and 21C supply the taken out sheet to the transport unit 5.

A sheet before decoloring, which is fed in a decoloring mode and on which an image is formed by the decolorable toner, is stored in at least one sheet feeding cassette of the sheet storage unit 4. However, the sheet before decoloring may be fed from a manual sheet feeding unit (not illustrated).

A sheet on which an image is formed by the decolorable toner may be also stored in at least one sheet feeding cassette of the sheet storage unit 4. The sheet on which the image is formed by the decolorable toner may be, for example, a sheet on which decoloring is completed in the decoloring mode. The sheet can be reused in a plurality of times by performing the image formation again by the decolorable toner with respect to the sheet on which decoloring is completed.

The transport unit 5 transports the sheet in the print unit 3 and the sheet storage unit 4. The transport unit 5 includes transport rollers 23 and resist rollers 24. The transport unit 5 transports the sheet supplied from the pickup rollers 21A, 21B, and 21C to the resist rollers 24. The resist rollers 24 transport the sheet in accordance with timing at which a transfer unit 28 of the print unit 3 which is described later transfers a toner image on the surface of the sheet. The transport rollers 23 cause a tip of the sheet in a transporting direction to abut against a nip N of the resist rollers 24. The transport rollers 23 adjust a position of the tip of the sheet in the transporting direction by bending the sheet. The resist rollers 24 transports the sheet to the transfer unit 28 side after aligning the tip of the sheet fed from the transport rollers 23 at the nip N.

Hereinafter, details of the print unit 3 will be described. The print unit 3 includes image forming units 25Y, 25M, 25C, 25K, and 25D, an exposure unit 26, an intermediate transfer belt 27, the transfer unit 28, and a fixing unit 29.

Each of the image forming units 25Y, 25M, 25C, 25K, and 25D forms the toner image to be transferred to the sheet. Each of the image forming units 25Y, 25M, 25C, 25K, and 25D has a photoconductive drum (image bearing member) 25*a*. The image forming units 25Y, 25M, 25C, 25K, and 25D have developing devices 25*b* which selectively supply the toner on surfaces of the photoconductive drums 25*a* respectively. The developing devices 25*b* have yellow, magenta, cyan, and black toners of the non-decolorable toner. The developing device 25*b* of the image forming unit 25D stores the decolorable toner. The decolorable toner is, for example, a blue toner. The decolorable toner forms the image using the image forming unit 25D having the same configuration of the image forming unit as those of 25Y, 25M, 25C and 25K.

The exposure unit 26 faces the photoconductive drum 25*a* of each of the image forming units 25Y, 25M, 25C, 25K, and 25D. The exposure unit 26 radiates laser light to the surface of the photoconductive drum 25*a* of each of the image forming units 25Y, 25M, 25C, 25K, and 25D based on the image data. The exposure unit 26 forms an electrostatic latent image on the surface of the photoconductive drum 25*a* of each of the image forming units 25Y, 25M, 25C, 25K, and 25D by applying the laser light. Each developing device 25*b* supplies the toner to the electrostatic latent image on the surface of each photoconductive drum 25*a* to develop the electrostatic latent image. Each developing device 25*b* causes the toner to adhere to the electrostatic latent image on the surface of each photoconductive drum 25*a* to form (develop) the toner image. The developing device 25*b* of the image forming unit 25Y develops the electrostatic latent image on the surface of the photoconductive drum 25*a* with yellow toner. The developing device 25*b* of the image forming unit 25M develops the electrostatic latent image on the surface of the photoconductive drum 25*a* with magenta toner. The developing device 25*b* of the image forming unit 25C develops the electrostatic latent image on the surface of the photoconductive drum 25*a* with cyan toner. The developing device 25*b* of the image forming unit 25K develops the electrostatic latent image on the surface of the photoconductive drum 25*a* with black toner. The developing device 25*b* of the image forming unit 25D develops the electrostatic latent image on the surface of the photoconductive drum 25*a* with the decolorable toner.

Each of the image forming units 25Y, 25M, 25C, 25K, and 25D transfers (primarily transfers) the toner image charged on the surface of each photoconductive drum 25*a* to the surface of the intermediate transfer belt 27. Each of the image forming units 25Y, 25M, 25C, 25K, and 25D applies the transfer bias to the toner image of each photoconductive drum 25*a* at each primary transfer position at which the primary transfer roller and the intermediate transfer belt 27 abut against each other. Each of the image forming units 25Y, 25M, 25C, and 25K superimposes and transfers the toner images of each color on the surface of each photoconductive drum 25*a* on the surface of the intermediate transfer belt 27. Each of the image forming units 25Y, 25M, 25C, and 25K superimposes and transfers the toner images of each color on the surface of the intermediate transfer belt 27 to form a color toner image. The image forming unit 25D transfers a decolorable toner image on the intermediate transfer belt 27.

The transfer unit 28 includes a support roller 28*a* and a secondary transfer roller 28*b* which pinch the intermediate transfer belt 27 and the sheet from both sides in a thickness direction. A position at which the support roller 28*a* and the secondary transfer roller 28*b* face each other is a secondary transfer position. The support roller 28*a* also functions as a counter electrode of the secondary transfer roller 28*b*. The transfer unit 28 transfers the toner image charged on the surface of the intermediate transfer belt 27 on the surface of the sheet by applying the transfer bias to the secondary transfer position in accordance with a transfer current.

Residual toner on the intermediate transfer belt 27 that is not transferred to the sheet in the transfer unit 28 is cleaned in a cleaning unit 271. For example, the cleaning unit 271 presses a tip of a blade against the intermediate transfer belt 27 to scrape off the toner on the intermediate transfer belt 27. The cleaning unit 271 may be in contact with a charged brush.

The fixing unit 29 fixes the toner image on the sheet at a fixing temperature in the normal operation mode. The fixing unit 29 decolorizes the decolorable toner formed on the sheet at a decoloring temperature higher than the fixing temperature in the decoloring mode. The decoloring temperature is a temperature of the fixing unit 29 which is sufficient to decolorize the decolorable toner formed on the sheet. The decoloring temperature is higher than a temperature on a property that the decolorable toner is decolorized and is determined by a heat capacity of the sheet or a sheet passing speed of the sheet in the fixing unit 29. For example, for the fixing unit 29, it is possible to use an IH heater using a phenomenon in which a member to be heated generates heat using an AC magnetic field. It is possible to facilitate temperature control in the fixing unit 29 by using the IH heater.

A reversing unit 30 reverses the sheet discharged from the fixing unit 29 by switchback. The reversing unit 30 transports the reversed sheet to the front of the resist rollers 24. The reversing unit 30 reverses the sheet to form the toner image on a back surface of the sheet subjected to the fixing process.

A case where the image forming unit 25 has the image forming units 25Y, 25M, 25C, 25K, and 25D of five colors is illustrated in FIG. 1. However, the configuration of the image forming unit 25 is not limited to the configuration. For example, the image forming unit 25 may have at least non-decolorable toner of one color.

A case where the image forming apparatus 10 is an image forming apparatus of a tandem type in which the image forming units 25Y to 25D perform the primary transfer of the toner image to the intermediate transfer belt is illustrated in FIG. 1. However, the image forming unit of the image forming apparatus 10 is not limited to the tandem type.

Next, a functional configuration of the image forming apparatus of the embodiment will be described with reference to FIG. 2.

Figure 2:
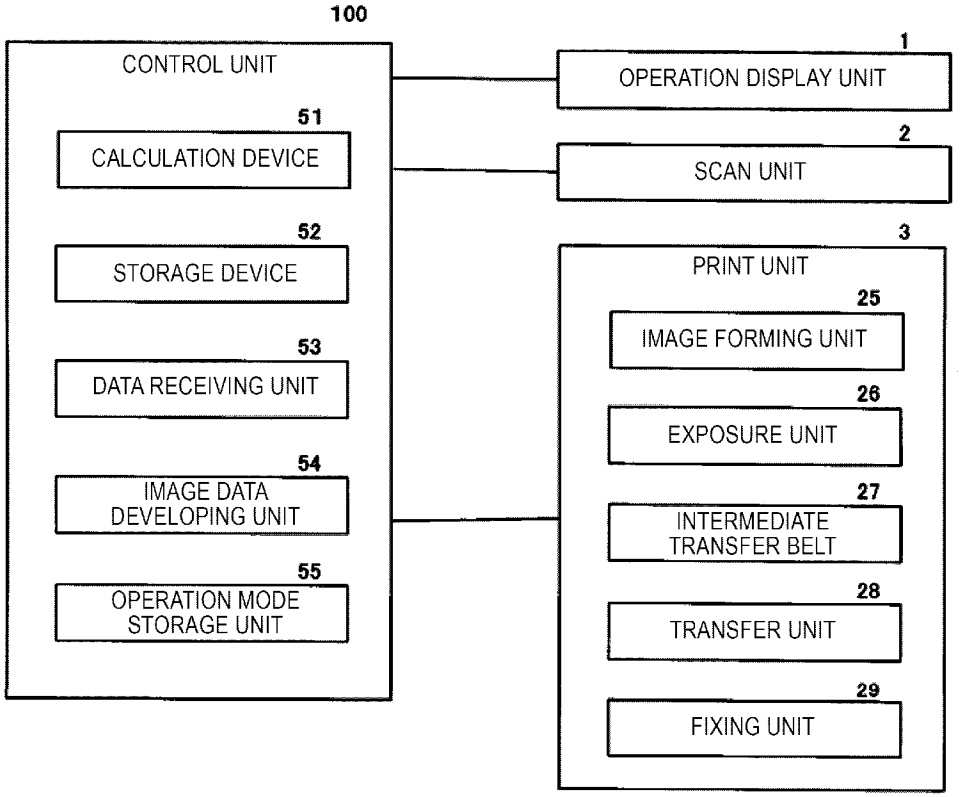
FIG. 2 is a block diagram illustrating an example of a functional configuration of the image forming apparatus of the embodiment.

In FIG. 2, the image forming apparatus 10 has each function of a control unit 100, the operation display unit 1, the scan unit 2, and the print unit 3. The print unit 3 has the image forming unit 25, the exposure unit 26, the intermediate transfer belt 27, the transfer unit 28, and the fixing unit 29.

The operation display unit 1 is, for example, a touch panel having the display unit 11 and the operation unit 12. The operation display unit 1 displays the normal operation mode exemplified as a first operation mode and the decoloring mode exemplified as a second operation mode so that the user can select the modes. The operation display unit 1 notifies the control unit 100 of the selected operation mode.

The control unit 100 has a calculation device 51 and a storage device 52. The calculation device 51 controls the operation display unit 1, the scan unit 2, and the print unit 3 in accordance with an image processing program stored in the storage device 52.

The calculation device 51 is, for example, a Central Processing Unit (CPU), Application Specific Integrated Circuit (ASIC), or the like. The storage device 52 is a Read Only Memory (ROM), Random Access Memory (RAM), Hard Disk Drive (HDD), Solid State Drive (SSD), or the like. A data receiving unit 53 receives print data (for example, data described in a page description language, or the like) indicating an image to be printed from a host such as a Personal Computer (PC) and stores the received print data in the storage device 52. An image data developing unit 54 determines print conditions from the print data stored in the storage device 52 by the data receiving unit 53 to develop data (for example, raster data or the like) capable of being printed by the print unit 3 and store the data in the storage device 52.

An operation mode storage unit 55 stores an operation mode selected in the operation display unit 1. The control unit 100 controls the operation of the image forming apparatus 10 in accordance with the operation mode stored in the operation mode storage unit 55.

The print unit 3 has the image forming unit 25, the exposure unit 26, the intermediate transfer belt 27, the secondary transfer unit 28, and the fixing unit 29. The print unit 3 forms an image on the sheet based on data stored in the storage device 52 by the image data developing unit 54. The print unit 3 prints the print data which is received by the data receiving unit 53 of the control unit 100 from the PC and stored in the storage device 52.

The control unit 100 applies the transfer bias having the same polarity as that of the charge of the toner to the support roller 28*a* when the sheet passes through the transfer unit 28 during forming an image on the sheet in the normal operation mode. Therefore, the control unit 100 can apply the transfer bias having the same polarity as that of the charge of the toner to the intermediate transfer belt 27 illustrated as the transfer member. The control unit 100 applies the transfer bias having the same polarity as that of the charge of the toner so that the toner image formed on the surface of the intermediate transfer belt 27 can be transferred to the sheet.

The control unit 100 applies the cleaning bias having the reverse polarity to that of the transfer bias to the support roller 28*a* when the sheet passes through the transfer unit 28 in the decoloring mode. Therefore, the control unit 100 can apply the cleaning bias having the reverse polarity to that of the transfer bias to the intermediate transfer belt 27. It is possible to prevent the toner from adhering to the sheet or the secondary transfer roller from the intermediate transfer belt 27 by applying the cleaning bias having the reverse polarity to that of the transfer bias to the intermediate transfer belt 27. Details of the cleaning bias applied to the intermediate transfer belt 27 will be described later.

Figure 3A:
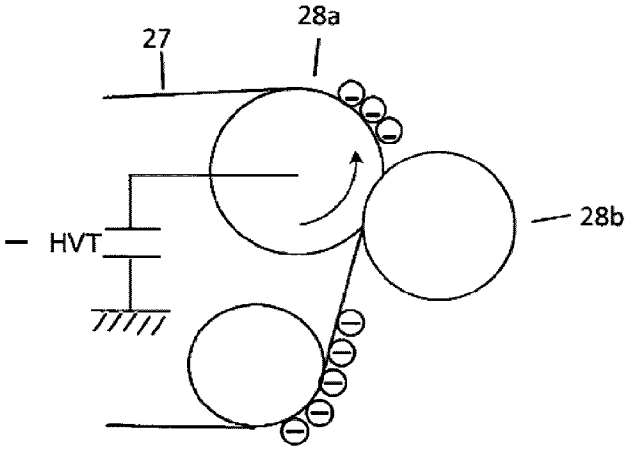
FIGS. 3A and 3B are views illustrating an example of a bias applied in a transfer unit of the image forming apparatus of the embodiment.
Figure 3B:
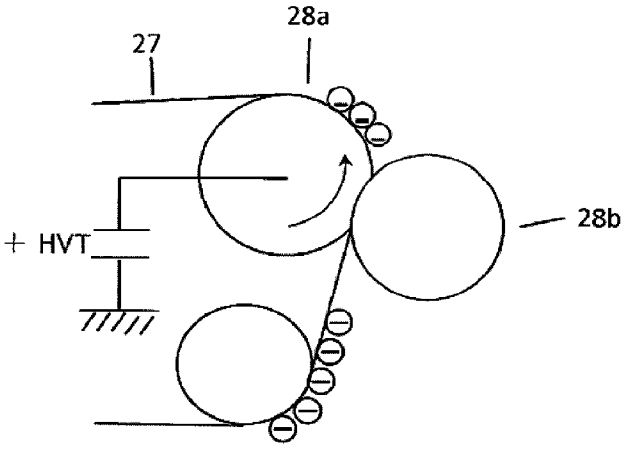

Next, the bias applied in the transfer unit 28 of the image forming apparatus 10 of the embodiment will be described with reference to FIGS. 3A and 3B. FIG. 3A illustrates a case where the transfer bias is applied to the intermediate transfer belt 27. FIG. 3B illustrates a case where the cleaning bias is applied to the intermediate transfer belt 27.

FIG. 3A illustrates a case where the transfer bias is applied to the intermediate transfer belt 27 when an image is formed on a sheet in the normal operation mode. In FIG. 3A, the toner image having a negative polarity is primarily transferred to the intermediate transfer belt 27. The intermediate transfer belt 27 is rotated and thereby the toner image on the intermediate transfer belt 27 is moved to the transfer unit 28 having the support roller 28*a* and the secondary transfer roller 28*b*. The sheet (not illustrated) is fed to the transfer unit 28 in synchronization with the rotation of the intermediate transfer belt 27. The control unit 100 applies a high voltage (HVT) of a negative charge to the support roller 28*a* thereby secondarily transferring the toner image on the intermediate transfer belt 27 to a sheet on the secondary transfer roller 28*b*. The toner that is not secondarily transferred to the sheet in the transfer unit 28 remains on the intermediate transfer belt 27 and is cleaned by the cleaning unit 271.

FIG. 3B illustrates a case where the cleaning bias is applied in the decoloring mode in which the toner on the sheet on which an image is formed with the decolorable toner having the decoloring function is decolorized. In FIG. 3B, in the intermediate transfer belt 27, the sheet that is decolorized by the fixing unit 29 passes through the transfer unit 28 in which scattered toner adheres to the surface of the intermediate transfer belt 27 and moves to the transfer unit 28 due to deterioration of charging characteristics of the toner in the developing device 25*b*. The control unit 100 applies the cleaning bias having the reverse polarity to that of the toner to the support roller 28*a* during the decoloring operation and attracts the toner to the intermediate transfer belt 27. If the toner is the negative polarity, the cleaning bias is a high voltage of positive charge. The toner is attracted to the intermediate transfer belt by applying the cleaning bias. Therefore, it is possible to prevent dirt of the toner on the intermediate transfer belt 27 from being transferred to the sheet or the secondary transfer roller 28*b* by applying the cleaning bias. Dirt of the toner on the intermediate transfer belt 27 is cleaned by the cleaning unit 271.

If a large amount of the toner is adhered to the intermediate transfer belt 27, even if the cleaning bias is applied to the intermediate transfer belt 27, the toner adhered to the intermediate transfer belt 27 may be adhered and deposited to the secondary transfer roller 28*b*. It is possible to clean the secondary transfer roller 28*b* and to cause the dirt of the toner to adhere to the sheet before passing the sheet to be decolorized by applying the cleaning bias in the decoloring mode.

Figures 4, 4A, 4B:
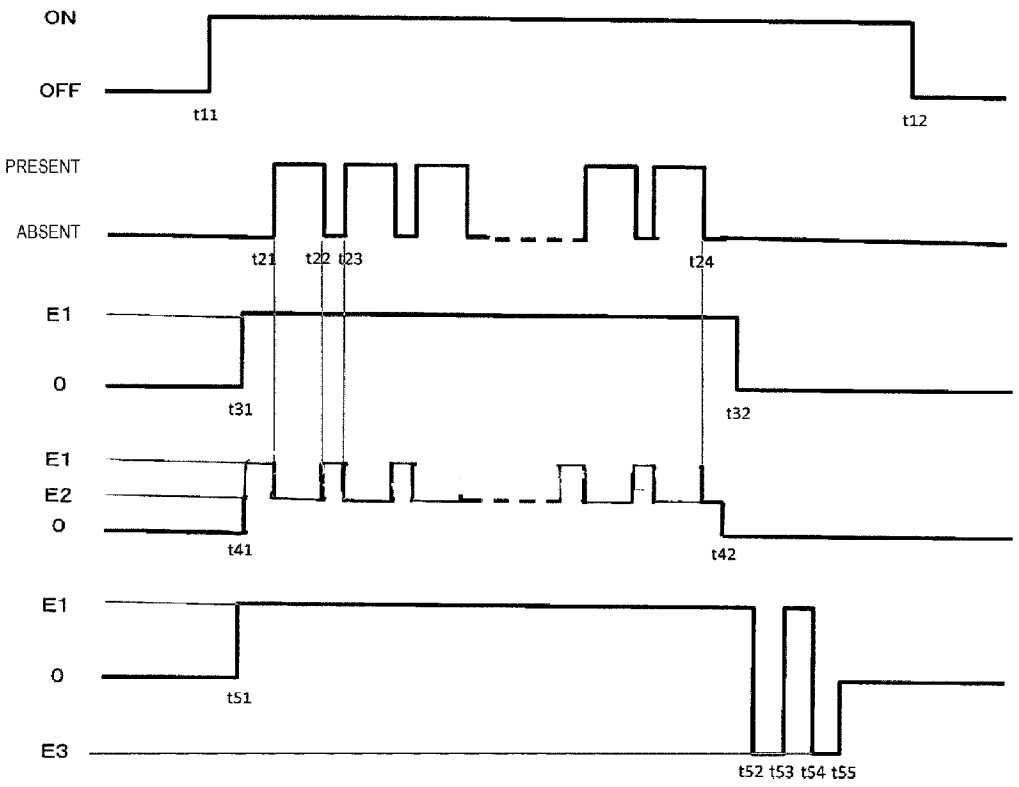
FIG. 4A is a timing chart illustrating an example of a decoloring operation of the image forming apparatus of the embodiment.
FIG. 4B is a timing chart illustrating an example of an existence of paper at a fixing unit.

Next, the decoloring operation of the image forming apparatus 10 of the embodiment will be described with reference to FIG. 4. FIGS. 4(A) to 4(C3) are timing charts in which a horizontal axis is an elapsed time.

FIG. 4(A) is a timing chart indicating whether the decoloring operation is in an ON state or in an OFF state. The ON state of the decoloring operation means a state where the decoloring mode is selected as the operation mode, for example, a start button is pressed, and a motor, which drives the photoconductive drum 25*a*, the developing device 25*b*, the primary transfer roller, the intermediate transfer belt 27, the transfer unit 28, the fixing unit 29, and the like, is rotated. In the decoloring mode, an image is not formed by the toner. However, the intermediate transfer belt 27 is driven to transport the sheet, and the photoconductive drum 25*a* or the developing device 25*b* is also driven by driving the intermediate transfer belt. In the ON state of the decoloring operation, no new toner is supplied and the developing device 25*b* is driven. Therefore, the surface of the toner is scraped by agitation by an auger of the developing device 25*b* and the charging characteristics of the toner are deteriorated. That is, the charging characteristics of the toner are deteriorated in accordance with a length of the ON state of the decoloring operation. Since the ON state of the decoloring operation continues until decoloring of the sheet to be decolorized is completed, the time of the ON state of the decoloring operation can be grasped as the number of the sheets (decolorized sheets) that are decolorized.

In FIG. 4(A), the decoloring operation is turned on at a time t11 and the decoloring operation is turned off at a time t12. The time t11 at which the decoloring operation is turned on is a time before at least a sheet which is an initial object to be decolorized reaches the transfer unit 28. The time t12 at which the decoloring operation is turned off is a time after a sheet which is the last object to be decolorized passes through the transfer unit 28.

FIG. 4(B) indicates presence or absence of a sheet (paper) in the transfer unit 28. Also in the decoloring mode, the sheet fed from the sheet storage unit 4 passes through the transfer unit 28 and is transported to the fixing unit 29. The transfer unit sheet "present" is a state where the sheet is present in the transfer unit 28 (between the intermediate transfer belt 27 and the secondary transfer roller 28*b*). The transfer unit sheet "absent" is a state (sheet interval) where the sheet is absent in the transfer unit 28. That is, the number of times of the transfer unit sheet "present" is the number of sheets of the object to be decolorized and the time of the transfer unit sheet "present" differs depending on the length and a transport speed of the sheet in the transporting direction. The time of the transfer unit sheet "absent" is determined by a sheet interval to be adjusted by the resist rollers 24. In the decoloring mode, since there is no need to synchronize with the intermediate transfer belt, it is possible to shorten the sheet interval as compared to the normal operation mode in which an image is formed.

In FIG. 4(B), a time t21 is a time at which the sheet of at least initial object to be decolorized reaches the transfer unit 28 and a time t22 is a time at which the sheet of the initial object to be decolorized passes through the transfer unit 28. A time t23 is a time at which a second sheet reaches the transfer unit 28. A time t24 is a time at which the sheet of the last object to be decolorized passes through the transfer unit 28. The t21 to t22 are a time required for the sheet to pass through the transfer unit 28 and the t22 to t23 is a time of the sheet interval. In FIG. 4(B), a case where the passing time and the sheet interval time are the same in all sheets is illustrated, but, for example, a transport speed or the like can be changed depending on the thickness of the sheet of the object to be decolorized or an amount of the decolorable toner on the sheet. When decoloring is insufficient, one sheet may be reversed by the reversing unit 30 and passes through the fixing unit 29 a plurality of times.

FIGS. 4(C1) to 4(C3) illustrate patterns of the cleaning bias that can be applied in the transfer unit 28. The control unit 100 can apply the cleaning bias to the transfer unit 28 in any one pattern of FIGS. 4(C1) to 4(C3).

FIG. 4(C1) illustrates a case where a cleaning bias E1 is applied to the transfer unit 28 from decoloring start to decoloring completion of the sheet of the object to be decolorized. As described in FIG. 3B, the cleaning bias E1 has a polarity of attracting the toner to the intermediate transfer belt 27. If the toner has the negative polarity, a positive charge is applied to the cleaning bias E1.

In FIG. 4(C1), a time t31 is a time at which application of the cleaning bias E1 is started. A time t31 is a time before the time t21 at which at least the sheet as an initial object to be decolorized reaches the transfer unit 28. A time t32 is a time at which the application of the cleaning bias E1 is completed. The time t32 is a time after the time t24 at which at least the sheet of last object to be decolorized passes through the transfer unit 28. In FIG. 4(C1), the control unit 100 also applies the same cleaning bias E1 in the t31 to t32. Therefore, if the dirt of the toner adheres to the secondary transfer roller 28*b*, the dirt of the toner may adhere to the back surface of the sheet. Even if the dirt of the toner adheres to the secondary transfer roller, the dirt of the toner adhered to the secondary transfer roller 28*b* can be attracted to the intermediate transfer belt 27. For example, the control unit 100 sets the t31 to t21 before the initial sheet reaches the transfer unit 28 to be longer than one rotation of the secondary transfer roller 28*b*. Therefore, the control unit 100 can attract the dirt of the toner adhered to the secondary transfer roller to the intermediate transfer belt 27 before the sheet as the initial object to be decolorized reaches the transfer unit 28. Similarly, the control unit 100 sets the sheet interval (for example, the t22 to t23) of the sheet to be longer than one rotation of the secondary transfer roller 28*b*. Therefore, the control unit 100 can clean the dirt of the toner by attracting the dirt of the toner adhered to the secondary transfer roller to the intermediate transfer belt 27.

FIG. 4(C2) illustrates a case where the cleaning bias E1 and a cleaning bias E2 are alternately applied to the transfer unit 28 from decoloring start to decoloring completion of the sheet of the object to be decolorized. The cleaning bias E1 is similar to that of FIG. 4(C1). The cleaning bias E2 has the same polarity as that of the cleaning bias E1 and is a cleaning bias having a voltage lower than that of the cleaning bias E1. When the sheet does not pass through the transfer unit 28, the toner adhered to the intermediate transfer belt 27 directly faces the intermediate transfer belt 27 and the secondary transfer roller 28*b* without the sheet. Therefore, the toner is prevented from adhering to the secondary transfer roller 28*b* by applying the cleaning bias E1. When the sheet is present in the transfer unit 28, the toner adhered to the intermediate transfer belt 27 is unlikely to adhere to the secondary transfer roller 28*b*. Therefore, even if the cleaning bias voltage is lowered, the dirt of the secondary transfer roller can be prevented. The control unit 100 can reduce power required to apply the cleaning bias by applying the cleaning bias E2. That is, the control unit 100 can prevent adhesion of the dirt of the toner to the sheet and to reduce power by applying the cleaning bias of FIG. 4(C2).

In FIG. 4(C2), a time t41 is a time at which application of the cleaning bias E1 is started. A time t42 is a time after the time t24 at which at least the sheet as the last object to be decolorized passes through the transfer unit 28. The control unit 100 switches the cleaning bias E1 and the cleaning bias E2 by presence or absence of the fixing unit sheet illustrated in FIG. 4(B) at the time t41 to t42. Also in FIG. 4 (C2), the control unit 100 sets the t41 to t21 before the initial sheet reaches the transfer unit 28 to be longer than one rotation of the secondary transfer roller 28*b*. Therefore, the control unit 100 can attract the dirt of the toner adhered to the secondary transfer roller to the intermediate transfer belt 27 before the sheet as the initial object to be decolorized reaches the transfer unit 28. Similarly, the control unit 100 sets the sheet interval (for example, the t22 to t23) of the sheet to be longer than one rotation of the secondary transfer roller 28*b*. Therefore, the control unit 100 can clean the dirt of the toner by attracting the dirt of the toner adhered to the secondary transfer roller to the intermediate transfer belt 27.

Similarly to FIG. 4(C1), FIG. 4(C3) illustrates a case where the cleaning bias E1 is applied to the transfer unit 28 from decoloring start to decoloring completion of the sheet of the object to be decolorized. In FIG. 4(C3), the control unit 100 applies a cleaning bias E3 having the reverse polarity to that of the cleaning bias E1 after the sheet of the last object to be decolorized passes through the transfer unit 28. The toner, which is charged with the negative polarity in the toner adhered to the secondary transfer roller 28*b*, can be adhered to the intermediate transfer belt 27 by the cleaning bias E1. However, the toner adhered to the secondary transfer roller 28*b* may be charged to a positive polarity. The toner charged to the positive polarity cannot be attracted to the intermediate transfer belt 27 by the cleaning bias E1. If the number of decoloring sheets increases, adhesion of the toner, which is charged to the positive polarity which cannot be attracted by the cleaning bias E1, to the secondary transfer roller 28*b* may increase. The toner charged to the positive polarity is attracted to the intermediate transfer belt 27 by applying the cleaning bias E3 having the reverse polarity to that of the cleaning bias E1. In FIG. 4(C3), the control unit 100 performs an operation (alternate application operation) of alternately applying the cleaning bias E1 and the cleaning bias E3. The control unit 100 performs the alternate application operation after the sheet as the last object to be decolorized passes through the transfer unit 28. The control unit 100 cleans the toner charged to the positive polarity after decoloring of a preset number of decoloring sheets is completed. Therefore, the control unit 100 can prevent occurrence of scumming (fogging).

In FIG. 4 (C3), a time t51 is a time at which the application of the cleaning bias E1 is started. The time t51 is a time before the time t21 at which at least the sheet as an initial object to be decolorized reaches the transfer unit 28. A time t52 is a time at which the application of the cleaning bias E1 is completed and the application of the cleaning bias E2 is started. The time t52 is a time after the time t24 at which at least the sheet as a last object to be decolorized passes through the transfer unit 28. The control unit 100 also applies the same cleaning bias E1 at the t51 to t52. Therefore, even if the dirt of the toner adheres to the secondary transfer roller, the dirt of the toner adhered to the secondary transfer roller 28*b* can be attracted to the intermediate transfer belt 27. For example, the control unit 100 sets the t51 to t21 before the initial sheet reaches the transfer unit 28 to be longer than one rotation of the secondary transfer roller 28*b*. Therefore, the control unit 100 can attract the dirt of the toner adhered to the secondary transfer roller to the intermediate transfer belt 27 before the sheet of the initial object to be decolorized reaches the transfer unit 28. Similarly, the control unit 100 sets the sheet interval (for example, the t22 to t23) of the sheet to be longer than one rotation of the secondary transfer roller 28*b*. Therefore, the control unit 100 can clean the dirt of the toner adhered to the secondary transfer roller 28*b*.

The control unit 100 completes the application of the cleaning bias E3 and starts the application of the cleaning bias E1 again at a time t53. The control unit 100 completes the application of the cleaning bias E1 and starts the application of the cleaning bias E3 again at a time t54. The control unit 100 completes the application of the cleaning bias E3 at the time t53. A combination of the cleaning bias E1 at the t24 to t52 and the cleaning bias E3 at the t52 to t53 is an alternate application operation of one cycle. FIG. 4(C3) illustrates a case where the alternate application operation is executed twice. However, the alternate application operation may be performed once or three times or more. The number of executions of the alternate application operation may be varied depending on an amount of the dirt of the toner adhered to the secondary transfer roller 28*b*. FIG. 4(C3) illustrates a case where the alternate application operation is performed one time from the cleaning bias E1 to the cleaning bias E3. However, the alternate application operation may be performed one time from the cleaning bias E3 to the cleaning bias E1.

FIG. 4(C3) illustrates a case where the alternate application operation is executed after the sheet of the last object to be decolorized passes through the transfer unit 28. However, if the number of decoloring sheets in a decoloring job of one time is large, an attachment amount of the toner which is charged to the positive polarity with respect to the secondary transfer roller 28*b* may increase. The control unit 100 may execute the alternate application operation when the number of decoloring sheets is equal to or greater than a preset number. For example, the alternate application operation may be executed every time the number of decoloring sheets reaches 100 sheets.

Next, a fogging amount in the image forming apparatus of the embodiment will be described with reference to FIGS. 5A and 5B.

Figure 5A:
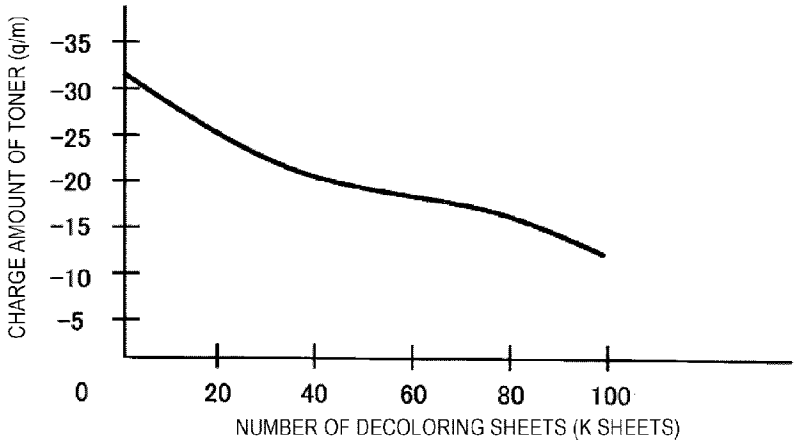
FIGS. 5A and 5B are diagrams illustrating an example of a change of a fogging amount in the image forming apparatus of the embodiment.

FIG. 5A is a diagram illustrating a relationship of the number of decoloring sheets and a change amount of the toner. A horizontal axis of the graph indicates the number of continuous decoloring sheets (K sheets). FIGS. 5A and 5B are graphs when the number of decoloring sheets is continuously to 100 K sheets (100,000 sheets).

A vertical axis of the graph indicates a charge amount q/m of the toner. Here, m is a toner weight contained in a predetermined amount of developer and q is a charge amount in the predetermined amount of the developer. That is, the charge amount of the toner is a charge amount per toner weight. The charge amount is measured by a blow-off method. The blow-off method is a method in which a developer is placed in a cylindrical Faraday cage in which wire gauzes are disposed at both ends, the toner is detached from the developer by high pressure air, and then the remaining charge is measured by an electrometer. The toner weight m in the developer can be obtained from a weight difference of the Faraday cage before and after blow-off.

In the developing device 25*b*, the developer is agitated by the rotation of the auger. In the decoloring mode, since no mew toner is replenished to the developing device 25*b* and the developer is agitated by the auger, the surface of the toner adhering to the carrier surface is gradually scraped and the charge amount decreases.

In FIG. 5A, when the number of decoloring sheets is 0 K sheet, the charge amount of the toner is approximately −32 q/m. As the number of decoloring sheets increases, the charge amount gradually decreases. When the number of decoloring sheets is 80 K sheets (80,000 sheets), the charge amount of the toner is approximately −15 q/m and when the number of decoloring sheets is 100 K sheets (100,000 sheets), the charge amount of the toner is approximately −12 q/m.

Figure 5B:
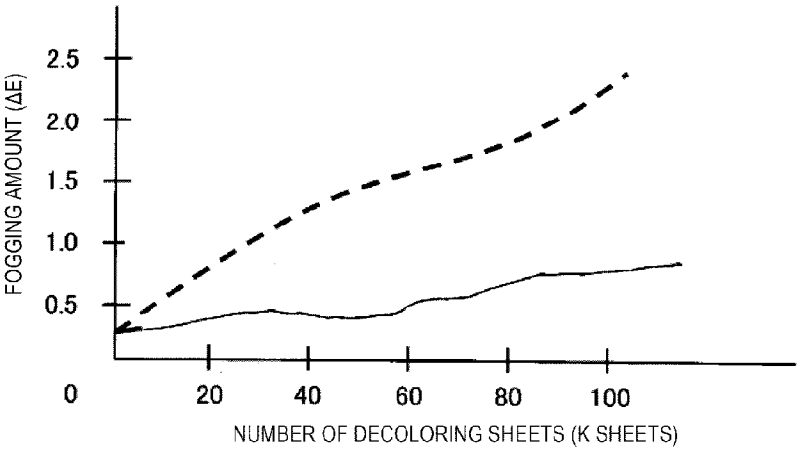

FIG. 5B is a graph illustrating a relationship of the number of decoloring sheets and the fogging amount. Similarly to FIG. 5A, a horizontal axis of the graph indicates the number of continuous decoloring sheets (K sheets). A vertical axis of the graph indicates a fogging amount (ΔE). The fogging amount (ΔE) measures a difference between a hue E of an unused sheet as a reference value and a hue E of a white solid portion of the sheet passing through the transfer unit 28. In the embodiment, among white solid portions of five places which are arbitrary measured, the largest difference from the reference value is the fogging amount (ΔE). FIG. 5B is the fogging amount (ΔE) by decoloring (passing through) of one time. Therefore, in the sheet to be recycled, the fogging amount (ΔE) is accumulated according to the number of reuses.

When the number of decoloring sheets increases, as illustrated in FIG. 5A, the charge amount of the toner decreases. If the charge amount of the toner decreases, the toner that is not transferred increases and the dirt of the toner of the white solid portion, and the fogging amount (ΔE) increases. The graph indicated by a broken line of FIG. 5B indicates a change of the fogging amount (ΔE) if the cleaning bias in the embodiment is not applied. In the broken line of FIG. 5B, when the number of decoloring sheets is 0 K sheet, the fogging amount (ΔE) is approximately 0.3. When the number of decoloring sheets increases, the fogging amount (ΔE) gradually increases. When the number of decoloring sheets is 80 K sheets, the fogging amount (ΔE) increases to approximately 1.8. When the number of decoloring sheets is 100 K sheets, the fogging amount (ΔE) increases to approximately 2.3.

The graph indicated by a solid line of FIG. 5B indicates a change of the fogging amount (ΔE) if the cleaning bias is applied by the method described in FIG. 4(C). In FIG. 5B, the alternate application operation is executed every 100 sheets of the number of decoloring sheets. Although the fogging amount (ΔE) gradually increases with the decrease in the charge amount of the toner, it is possible to reduce the increase and to reduce the fogging amount. It is possible not to reduce the number of reuses of the sheets by reducing the fogging amount.

The graph indicated by the solid line of FIG. 5B indicates an increase in the fogging amount by linear approximation. The increase in the fogging amount varies depending on, for example, the type of toner or sheet, temperature and humidity conditions where the image forming apparatus is installed, or the like.

Next, an operation of the image forming apparatus of the embodiment will be described with reference to FIG. 6.

Figure 6:
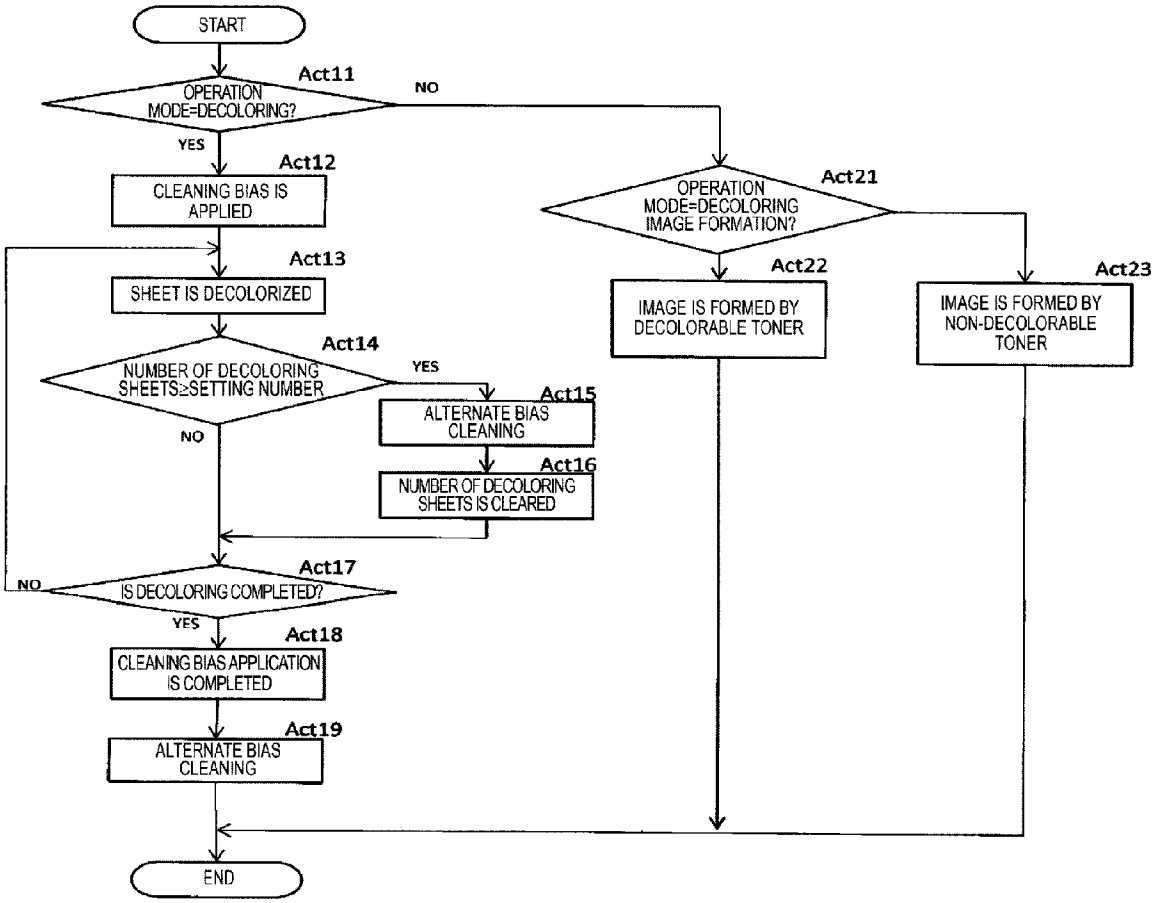
FIG. 6 is a flow chart illustrating an example of an operation of the image forming apparatus of the embodiment.

In FIG. 6, the control unit 100 determines whether or not the operation mode is the decoloring mode (Act11). Whether or not the operation mode is the decoloring mode can be determined by reading, for example, the operation mode stored in the operation mode storage unit 55.

In a case where it is determined that the operation mode is the decoloring mode (Act11: YES), the control unit 100 starts the application of the cleaning bias E1, for example, by pressing the start button of the operation unit 12 (Act12). The cleaning bias E1 is a bias for attracting the toner that continues to be applied until decoloring is completed to the intermediate transfer belt 27.

After executing the process of Act12, the control unit 100 executes decoloring of the sheet (Act13). Decoloring of the sheet is executed by transporting the sheets before decoloring stored in the sheet storage unit 4 one by one to the fixing unit 29 and heating the sheet.

After executing the process of Act13, the control unit 100 determines whether or not the number of decoloring sheets is a preset number or more (Act14). Whether or not the number of decoloring sheets is the preset or more can be determined, for example, by determining whether or not the number of decoloring sheets is the number of continuous decoloring sheets, which is set in advance, or more. If it is determined that the number of decoloring sheets is the preset number or more (Act14: YES), the control unit 100 executes cleaning using alternate bias (Act15). The cleaning by the alternate bias can be performed by alternately applying, for example, the cleaning bias E1 and the cleaning bias E3.

After executing the process of Act15, the control unit 100 clears the number of decoloring sheets (Act16). The number of decoloring sheets that is cleared in the process of Act16 is the number of decoloring sheets in the process of continuous Act13, which is determined in Act14.

On the other hand, if it is determined that the number of decoloring sheets is not equal to or greater than the preset number (Act14: NO), or after executing the process of Act16, the control unit 100 determines whether or not decoloring is completed (Act17). Whether or not decoloring is completed can be performed by determining whether or not the sheet before decoloring stored in the sheet storage unit 4 is absent. If it is determined that decoloring is not completed (Act17: NO), the control unit 100 executes the process of Act13 again and repeats the process of Act13 to Act17 until decoloring is completed.

On the other hand, if it is determined that decoloring is completed (Act17: YES), the control unit 100 completes the application of the cleaning bias E1 (Act18). After executing the process of Act18, the control unit 100 executes cleaning using the alternate bias (Act19).

On the other hand, in the process of Act11, if it is determined that the operation mode is not the decoloring mode (Act11: NO), the control unit 100 determines whether or not the operation mode is the image formation using the decolorable toner (Act21). Whether or not the operation mode is the image formation using the decolorable toner can be determined by reading, for example, the operation mode stored in the operation mode storage unit 55.

If it is determined that the operation mode is the image formation using the decolorable toner (Act21: YES), the control unit 100 executes the image formation using the decolorable toner (Act22). The image formation by the decolorable toner is executed by using the image forming unit 25D. On the other hand, if it is determined that the operation mode is not the image formation using the decolorable toner (Act21: NO), the control unit 100 executes the image formation using the non-decolorable toner (Act22). The image formation by the non-decolorable toner is executed by using at least one image forming unit in the image forming units 25Y, 25C, 25M, or 25K.

After the process of Act19, the process of Act22, or the process of Act 23, the control unit 100 completes the operation of the image forming apparatus 10 illustrated in the flowchart.

The image forming apparatus of the embodiment described above has the first operation mode in which the image is formed on the sheet with the toner and the second operation mode in which the toner on the sheet on which the image is formed with the decolorable toner having the decoloring function is decolorized, in which in the first operation mode, when the sheet passes through the transfer unit, the transfer bias having the same polarity as that of the charge of the toner is applied to the transfer member and the toner image formed on the surface of the transfer member is transferred to the sheet, and in the second operation mode, when the sheet passes through the transfer unit, the cleaning bias having the reverse polarity to the transfer bias is applied to the transfer member. With the configuration, it is possible to prevent the dirt of the sheet due to the decolorable toner during the decoloring operation of the decolorable toner and it is possible not to reduce the number of reuses.

In the image forming apparatus of the embodiment, in the second operation mode, when the sheet is in contact with the transfer member, the cleaning bias is applied with the first voltage and when the sheet is not in contact with the transfer member, the cleaning bias is applied with the second voltage lower than the first voltage. With the configuration, the dirt of the sheet due to the non-decolorable toner is prevented during the decoloring operation of the decolorable toner and it is possible not to reduce the number of reuses and further save power.

In the image forming apparatus of the embodiment, in the second operation mode, when the sheet is not in contact with the transfer member, the alternate application operation, in which the bias having the same polarity as that of the cleaning bias and the bias having the reverse polarity to that of the transfer bias are alternately applied according to the rotation of the transfer roller facing the transfer member, is executed. With the configuration, it is possible to perform cleaning of both the toner that is charged to the positive polarity and the toner that is charged to the negative polarity.

In the image forming apparatus of the embodiment, the apparatus further includes the sheet feeding unit capable of setting the sheet of the object to be decolorized and the alternate application operation is executed after decoloring of all the set sheets is completed. With the configuration, it is possible to perform cleaning of the both the toner that is charged to the positive polarity and the toner that is charged to the negative polarity after decoloring of the sheet is completed.

In the image forming apparatus of the embodiment, when the number of decolorized sheets is the preset number or more, the alternate application operation is executed. With the configuration, even if the number of decoloring sheets increases, the dirt of the sheet is prevented by the non-decolorable toner during the decoloring operation of the decolorable toner and it is possible not to reduce the number of reuses.

According to at least one embodiment described above, the image forming apparatus has the first operation mode and the second operation mode. Therefore, the dirt of the sheet due to the non-decolorable toner is prevented during the decoloring operation of the decolorable toner and it is possible not to reduce the number of reuses.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus having a first operation mode in which an image is formed on a sheet with toner and a second operation mode in which the toner on the sheet on which the image is formed with decolorable toner having a decoloring function is decolorized, the apparatus comprising:

a transfer unit configured to transport a formed toner image and transfers the transported toner image on the sheet;

a voltage supply unit configured to supply a bias voltage to the transfer unit; and a control unit configured to supply a transfer bias to a transfer member when the sheet passes through the transfer unit in the first operation mode, and supply a cleaning bias having a reverse polarity to that of the transfer bias to the transfer member when the sheet passes through the transfer unit in the second operation mode wherein in the second operation mode, when the sheet is in contact with the transfer member, the cleaning bias is supplied at a first voltage and wherein when the sheet is not in contact with the transfer member, the cleaning bias is supplied at a second voltage higher than the first voltage.

2. The apparatus according to claim 1, wherein in the second operation mode, when the sheet is not in contact with the transfer member, an operation, which alternately supplies a bias having the same polarity as that of the cleaning bias and a bias having a reverse polarity to that of the cleaning bias to the transfer member, is executed.

3. The apparatus according to claim 2, further comprising:

a sheet feeding unit configured to be capable of feeding sheets to be decolorized, wherein the alternate supplying operation is executed after decoloring of all the sheets that have been fed is completed.

4. The apparatus according to claim 2, wherein when a number of decolorized sheets reaches a preset number, the alternate supplying operation is executed.

* * * * *